United States Patent [19]

Ward et al.

[11] B 3,981,682

[45] Sept. 21, 1976

[54] CORROSION INHIBITING COMPOSITIONS AND PROCESS FOR INHIBITING CORROSION OF METALS

[75] Inventors: Benjamin F. Ward; William G. Vardell, both of Charleston, S.C.

[73] Assignee: Westvaco Corporation, New York, N.Y.

[22] Filed: Nov. 29, 1974

[21] Appl. No.: 527,999

[44] Published under the second Trial Voluntary Protest Program on February 3, 1976 as document No. B 527,999.

Related U.S. Application Data

[62] Division of Ser. No. 341,588, March 15, 1973, abandoned.

[52] U.S. Cl. ..... 21/2.7 R; 44/66; 44/70; 44/71; 252/396

[51] Int. Cl.[2] ..... C23F 9/02; C23F 11/00; C23F 11/10

[58] Field of Search ..... 44/66, 70, 71; 252/396; 21/2.7 R

[56] References Cited

UNITED STATES PATENTS

| | | | |
|---|---|---|---|
| 2,632,695 | 3/1953 | Landis et al. | 44/66 |
| 3,763,053 | 10/1973 | Bills | 252/357 |

*Primary Examiner*—Daniel E. Wyman
*Assistant Examiner*—Y. Harris-Smith
*Attorney, Agent, or Firm*—Richard L. Schmalz; Ernest B. Lipscomb, III

[57] ABSTRACT

Disclosed herein are additives for petroleum hydrocarbons, e.g., gasoline, oil, and solvents, to inhibit corrosion or rusting of metals. The additives comprise a major amount of a liquid $C_{21}$-dicarboxylic acid having the following structure, the bis-alkanolamide derivative of this material, the mono-alkanolamide derivative of this material, or the salt of the monoalkanolamide derivative of this material:

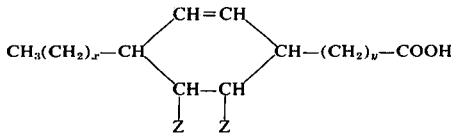

wherein $x$ and $y$ are integers from 3 to 9, $x$ and $y$ together equal 12 and Z is a member of the group consisting of hydrogen and COOH, with one Z of each moiety. An additional aspect of the subject invention is that the $C_{21}$-dicarboxylic acid of the formula shown above may be blended with up to 80% by weight of such fatty acids as oleic acid, coconut fatty acid, soya fatty acid, tall oil fatty acids and others and still retain significant corrosion inhibiting properties. The alkanolamides are made by reacting the dicarboxylic acid or its sodium or potassium soap and monoethanolamine, diethanolamine or isopropanolamine.

2 Claims, No Drawings

CORROSION INHIBITING COMPOSITIONS AND PROCESS FOR INHIBITING CORROSION OF METALS

This is a division of application Ser. No. 341,588, filed Mar. 15, 1973, now abandoned.

1. FIELD OF THE INVENTION

This invention relates to the inhibition of corrosion and/or rusting of metal when in contact with an aqueous medium, especially in internal combustion engines, pipelines, or storage tanks. More particularly, this invention relates to the use of liquid $C_{21}$-dicarboxylic acid, blends of these acids with other fatty acids, and bis-alkanolamide and mono-alkanolamide derivatives of the dicarboxylic acid as additives for use in preventing corrosion or rusting of metals, e.g., iron, steel and ferrous alloys.

2. BACKGROUND OF THE INVENTION

Corrosion inhibitors are designed to be effective in concentrations of only a few parts per million of hydrocarbon and to protect the metal surfaces of internal combustion engines, storage tanks and the like from rusting. Since moisture or liquid water is almost always present as contamination from some source, rusting is usually a problem. With changing temperatures over the course of 24 hours, the vapors in a tank expand or contract. When they contract, air is drawn into the tank and subsequently the engine, and the moisture contained in the air may condense. Considerable volume of water may be introduced during long tank storage, especially during humid weather. The dangers of rusting during storage lie in the damage to costly equipment and contamination of the fuel of particles of iron oxide which may scale off the walls of the tank.

As is well known, fatty acids and in particular, polymerized fatty acids, known as dimer acids, are used as corrosion inhibitors in numerous systems. Examples of dimer acids disclosed in the prior art for use as corrosion inhibitors are described in U.S. Pat. No. 2,482,761 to Goebel, U.S. Pat. No. 2,631,979 to McKermott and U.S. Pat. No. 2,632,695 to Landis. Those patents, among others, discuss the especially suitable polymer acids as polymerized diunsaturated monocarboxylic acids, e.g., dilinoleic acid and the dimeric acids obtained by the distillation of castor oil in the presence of sodium hydroxide. Other sources for obtaining the dimeric acids are from tall oil fatty acids, such as oleic or linoleic acids.

It is therefore a general object of this invention to provide new and improved corrosion and rusting inhibiting compositions which readily forms a protective coating on surfaces either directly or as a hydrocarbon addition.

Another object of this invention is to provide a new and improved process for inhibiting corrosion and rusting of metal equipment, such as internal combustion engines and storage tanks.

Still another object of this invention is to provide corrosion inhibiting compositions comprising blends of $C_{21}$-dicarboxylic acids and other fatty acids.

An even further object of this invention is to provide a corrosion inhibiting composition of the bis-alkanolamide and mono-alkanolamide derivatives of $C_{21}$-dicarboxylic acid.

Other objects, features and advantages of the invention will be evident from the following disclosure.

SUMMARY OF THE INVENTION

It has been found that new and improved results in inhibiting corrosion, particularly inhibiting the corrosion and rusting of metal, particularly ferrous metals in internal combustion engines and storage tanks, are obtained by applying directly to the metals or as an addition to a hydrocarbon, such as gasoline, oil or solvent, a corrosion inhibitor which may be described as having the following structure:

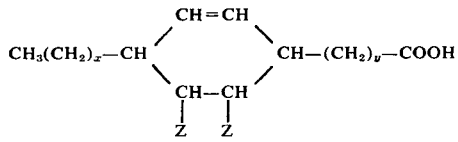

wherein $x$ and $y$ are integers from 3 to 9, $x$ and $y$ together equal 12 and Z is a member of the group consisting of hydrogen and COOH, with one Z of each moiety. In addition, the structure shown above may be hydrogenated to saturate the double bond.

An additional aspect of the subject invention is that the $C_{21}$-dicarboxylic acid may be blended with up to 80% by weight of such fatty acids as oleic acid, coconut fatty acid, soya fatty acid, tall oil fatty acids and others and still retain significant corrosion and rust inhibiting properties. In addition to the $C_{21}$-dicarboxylic acids and blends, it has been found that the bis-alkanolamide derivatives and the mono-alkanolamide derivatives of the $C_{21}$-dicarboxylic acid are also effective corrosion and rust inhibitors.

The corrosion inhibitors of this invention are effective when added to hydrocarbons in the range of 1 p.p.m. to 200 p.p.m. by weight, preferably 5–100 p.p.m., and in the aqueous layer when added in the range of 10 p.p.m.

DETAILED DESCRIPTION OF THE INVENTION

Protection of metal surfaces from rust and corrosion is an important factor in many fields of technology. One manner of providing such protection is by use of a corrosion inhibitor which forms a protective film on a metal surface, which film resists attack of the surfaces by corrosive agents in the fluid with which the surface would otherwise come in direct contact. The present invention provides a highly effective inhibitor for the prevention of rust and corrosion in internal combustion engines.

The requirements of a rust and corrosion inhibitor for hydrocarbon fuels, such as gasoline and avaiation fuel, include, for example; it must protect all equipment while in contact with the inhibited gasoline and water, it must not cause color change in the gasoline, and it must not effect octane rating or any other specification under which gasoline is sold.

The corrosion and rust inhibiting material of the subject invention comprises a major amount of a liquid $C_{21}$ organic acid having the following structure:

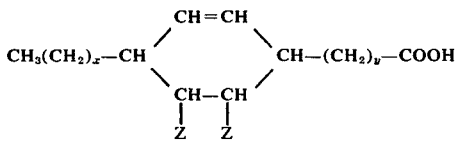

wherein $x$ and $y$ are integers from 3 to 9, $x$ and $y$ together equal 12 and Z is a member of the group consisting of hydrogen and COOH, with one Z of each moiety. Also contemplated is the hydrogenated structure of the $C_{21}$-dicarboxylic acid. Typical properties of the $C_{21}$dicarboxylic acid of the above structure are as follows:

Typical Properties of $C_{21}$-Dicarboxylic Acid

| | |
|---|---|
| Acid Number | 290 |
| Saponification Number | 310 |
| Iodine Number | 58 |
| Dicarboxylic Acid, % | 94 |
| Monomeric Acid, % | 5 |
| Unsaponifiables, % | 1 |
| Color, Gardner | 5 |
| Density, 25°C. | 1.016 |
| Viscosity, 100°F. (cSt) | 3,200 |
| 210°F. (cSt) | 90 |

The $C_{21}$-dicarboxylic acids for use in the subject invention are obtained from fatty acid sources containing linoleic acid. One such process for obtaining the $C_{21}$-dicarboxylic acids for use in this invention is set forth in patent application Ser. No. 159,070, filed July 1, 1971 now U.S. Pat. No. 3,753,968 granted Aug. 21, 1973.

An additional aspect of the subject invention is that it has been found that the $C_{21}$-dicarboxylic acids described hereinabove are also effective when mixed or blended with fatty acids from other sources such as oleic acids, soya fatty acids, coconut fatty acids, and even dimer acids. These mixtures of the dicarboxylic acid and other fatty acid or dimer will be referred to as hereinafter as "blends". The blends may comprise up to 80% by total weight of the fatty acid with the remainder being the $C_{21}$-dicarboxylic acid. An especially preferred blend is of a composition containing 50% of the $C_{21}$-dicarboxylic acid and 50% by weight of oleic acid.

As stated, the bis-alkanolamide derivatives and the mono-alkanolamide derivatives of $C_{21}$-dicarboxylic acid are also effective rust and corrosion inhibitors. In this regard, reference is made to U.S. Patent application Ser. No. 233,709 filed Mar. 10, 1972 now U.S. Pat. No. 3,763,053 granted Oct. 2, 1973 disclosing these derivatives and how to make them. The method of preparing the bis-alkanolamides and monoalkanolamides for use in this invention comprises, in general, reacting the $C_{21}$-dicarboxylic acid or a mixture of $C_{21}$-dicarboxylic acid and other fatty acid with an alkanolamine from the group consisting of monoethanolamine, diethanolamine or isopropanolamine and others at a mole ratio of from 0.5:1 to 1:1 alkanolamine per carboxyl group at temperatures sufficiently high to produce the condensation reaction to form the alkanolamide.

A preferred method of producing the monoalkanolamides for use in this invention is to mix the half soap of $C_{21}$-dicarboxylic acid with diethanolamine in equimolar quantity plus a small amount of excess alkanolamine, i.e., 3%, and then heat this mixture to between 140°–200°C., preferably 150°–170°C. until the mono-alkanolamide is formed, while removing the water of the reaction. The alkanolamides of monosoaps of $C_{21}$-dicarboxylic acid are generally either solids or very viscous liquids, but have one attribute not generally afforded by normal alkanolamides — water solubility. The mono-alkanolamide soap itself is an effective rust and corrosion inhibitor or it may be reclaimed to the free acid and used. The free acid form of the mono-alkanolamine derivative of $C_{21}$-dicarboxylic acid is preferred in most applications.

The quantity of the effective corrosion inhibitor required to retard or prevent corrosion is very small being on the order of a molecular film on the ferrous metal surface. The corrosion inhibitor may be applied to the metal surface as a mixture in a hydrocarbon, such as gasoline in a gasoline storage tank. As stated, the corrosion inhibitors are used to reduce rusting of metals in, for example, storage tanks and water is almost always present in varying amounts, thus giving a two-phase system. The corrosion inhibitors of this invention are effective in the hydrocarbon layer in a range from about one part per million (p.p.m.) to 200 parts per million by weight of hydrocarbon, preferably 5 to 100 parts per million. In the aqueous (water) layer the corrosion inhibitor is added in the range of 10 parts per million to 200 parts per million by weight, preferably 25 to 100 parts per million.

The corrosive fluids which may be treated in the practice of the invention include hydrocarbon fluids containing water such as, crude petroleum as it comes from the well, petroleum distillates such as fuel oil, diesel oil, kerosene, gasoline, aviation fuel and mixtures of petroleum hydrocarbons and brine. Additionally, the compositions are especially advantageous because they are compatable with petroleum and have no adverse effect thereon. The unique chemical nature of the compositions, particularly the presence of the long chain fatty acid groups with one carboxyl or other functional group at the end and the other in the middle of the chain assist in providing better adsorption and larger coverage on metal surfaces which are to be protected against corrosion. An advantage of the dicarboxylic acid, blends and derivatives as corrosion inhibitors of this invention is that they may be prepared as liquid at room temperture and do not need wetting agents or dispersing agents.

Test Procedure: The tests run in this disclosure simulate the conditions in a storage tank where a separate water layer can exist. This is the most strigent situtation and therefore an important test of anti-rusting properties of a molecule. Thus results recorded in the water layer are an extreme case; whereas the results in the hydrocarbon layer are the more realistic of the two situations. To test the effectiveness as corrosion inhibitors of the $C_{21}$-dicarboxylic acids, blends and derivatives of this invention, the subject compounds were tested by placing a polished rectangular coupon of cold rolled T-1010 carbon steel in a closed glass jar containing 10% distilled water and 90% iso-octane by volume in which a known amount of the sample being tested has been dissolved. The jar was allowed to stand in a water bath at 30°C. for 24 hours after which time the coupon was examined for rust. The results are visually observed and recorded according to the following keys:

| Key Rusting in Iso-Octane Layer | Key Rusting in Aqueous Layer |
|---|---|
| 0 - no rust | 0 - no rust or stain |
| 1 - trace of rust on corners or edges | 1 - trace of rust on corners or edges |
| | 2 - rust on faces |

-continued

| Key Rusting in Iso-Octane Layer | Key Rusting in Aqueous Layer |
|---|---|
| 2 - rust spots on faces | |

The practice of this invention may clearly be seen in the following examples.

EXAMPLE 1

In this example the rust inhibiting effects of the $C_{21}$-dicarboxylic acid and blends of $C_{21}$-dicarboxylic acid with other fatty acids were tested according to the procedure outlined above and compared to a dimer acid, a commercially available rust inhibitor. Dimer acids are a commercial form of a dimeric polymer consisting essentially of dilinoleic acid. Dimer acids typically contain about 85% dimer content, 12% trimer and higher content and about 3% monomer content.

The corrosion inhibiting additives were dissolved in the 10% water/90% iso-octane mixture at additive levels varying between 10 p.p.m. and 200 p.p.m. The results were visually observed and summarized in Table I.

Table 1

| Additive | Aqueous Layer Parts Per Million (p.p.m.) | | | | |
|---|---|---|---|---|---|
| | 200 | 100 | 50 | 25 | 10 |
| No Additive | 2 | 2 | 2 | 2 | 2 |
| Dimer Acid[a] | 2 | 0 | 1 | 2 | 2 |
| $C_{21}$-Dicarboxylic Acid | 1 | 0 | 1 | 1 | 2 |
| Hydrogenated $C_{21}$-Dicarboxylic Acid | — | 0 | 0 | 0 | — |
| Dicarboxylic Acid 50%/oleic acid 50% blend | 0 | 0 | 1 | 2 | 2 |

Notes: [a]1024 by Emery Industries.

The results show that the $C_{21}$-dicarboxylic acid, both saturated and unsaturated, and blend of $C_{21}$-dicarboxylic acid/oleic acid substantially reduced rusting in the aqueous layer. All the test coupons in this group except the one in the no additive mixture were free of rust in the isooctane layer. The mixture with no additive rusted very heavily in both the iso-octane (hydrocarbon) and the aqueous (water) layers. Thus the $C_{21}$-dicarboxylic acid is an effective corrision and rust inhibitor.

EXAMPLE 2

This example illustrates the effectiveness as a rust inhibitor of the bis-alkanolamide derivatives of $C_{21}$-dicarboxylic acid. Bis-alkanolamide derivatives of diethanolamine and monoethanolamine were tested by the procedure outlined above at from 10 p.p.m. to 100 p.p.m. for corrosion inhibition in a 10% distilled water and 90% iso-octane mixture. The results are shown in Table II and show that the bis-alkanolamides of $C_{21}$-dicarboxylic acids did act as rust inhibitors.

Table II

| | Iso-Octane Layer (p.p.m) | | | Aqueous Layer (p.p.m.) | | |
|---|---|---|---|---|---|---|
| | 100 | 50 | 10 | 100 | 50 | 10 |
| No Additive | 2 | 2 | 2 | 2 | 2 | 2 |
| Diethanolamide of Distilled Tall Oil Fatty Acid | 0 | 1 | 2 | 0 | 0 | 2 |
| Bis-diethanolamide of $C_{21}$-Dicarboxylic Acid | 1 | 0 | 2 | 0 | 1 | 2 |
| Bis-monoethanolamide of $C_{21}$-Dicarboxylic Acid | 1 | 1 | 2 | 2 | 2 | 2 |

Table III

| Sample No. | Description | Iso-Octane Layer (p.p.m.) | | | | | | Aqueous Layer (p.p.m.) | | | | | |
|---|---|---|---|---|---|---|---|---|---|---|---|---|---|
| | | 100 | 50 | 25 | 10 | 7.5 | 5 | 100 | 50 | 25 | 10 | 7.5 | 5 |
| 1 | No Additive | 2 | 2 | 2 | 2 | 2 | 2 | 2 | 2 | 2 | 2 | 2 | 2 |
| 2 | Amoco Premium Gas[a] | 2 | — | — | — | — | — | 2 | — | — | — | — | — |
| 3 | Tolad T-245[b] | — | 0 | 0 | 1 | 1 | 1 | — | 0 | 0 | 0 | 1 | 1 |
| 4 | Mono-diethanolamide of $C_{21}$-Dicarboxylic Acid | 0 | 0 | 0 | 0 | 0 | 0 | 0 | 0 | 0 | 0 | 1 | 1 |
| 5 | Monoamide (half soap of Sample 4) | 0 | 0 | 1 | 1 | 1 | — | 0 | 0 | 0 | 1 | 1 | 1 |
| 6 | Mono-monoethanolamide of $C_{21}$-Dicarboxylic Acid | 0 | 0 | 0 | 0 | 0 | 0 | 0 | 0 | 0 | 0 | 1 | 2 |

Notes:
[a]Amount of Additive unknown — no additional additives were made.
[b]Tolad T-245 is a commercially available corrosion inhibitor for use in distillate fuels. It is manufactured by Tretolite Co., a division of Petrolite Corporation.

EXAMPLE 3

This example illustrates the rust inhibiting effectiveness of monoalkanolamides. Mono-alkanolamide derivatives were made by reacting the $C_{21}$-dicarboxylic acid with diethanolamine and monethanolamine. In addition, the half amide — half soap of the mono-dialkanolamide was tested. The materials were tested in the 90% iso-octane/10% distilled water mixture at levels from 5 p.p.m. to 100 p.p.m. for rust inhibition and compared to several well known inhibitors. The results are shown in Table III. These results show the mono-dialkanolamide derivative of $C_{21}$-dicarboxylic acid to be an especially preferred rust inhibitor.

While the invention has been described and illustrated herein by references to various specific materials, procedures and examples it is understood that the invention is not restricted to the particular materials, combinations of materials and procedures selected for that purpose. Numerous variations of such details can be employed as will be appreciated by those skilled in the art.

What is claimed is:

1. A process for rust inhibition of metallic surfaces contacted by petroleum hydrocarbons and aqueous media which comprises, contacting said metallic substances with from 1 to 200 parts per million of an additive of the group consisting of a dicarboxylic acid having the following structure:

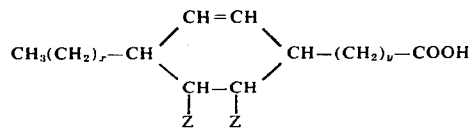

wherein $x$ and $y$ are integers from 3 to 9, $x$ and $y$ together equal 12, and Z is a member of the group consisting of hydrogen and COOH with one Z of each moiety, the hydrogenated dicarboxylic acid of said structure, the bisalkanolamide derivatives of said dicarboxylic acid, the mono-alkanolamide derivatives of said dicarboxylic acid, and the mono-alkanolamide derivatives of a soap of said dicarboxylic acid.

2. The process of claim 1 wherein said metallic surfaces are contacted with from 5 to 100 parts per million of said additive.

* * * * *

UNITED STATES PATENT OFFICE
CERTIFICATE OF CORRECTION

PATENT NO. : 3,981,682
DATED : September 21, 1976
INVENTOR(S) : Benjamin F. Ward and William G. Vardell It is certified that error appears in the above-identified patent and that said Letters Patent are hereby corrected as shown below:

In column 2, line 38, after "10 p.p.m." insert --to 200 p.p.m. by weight, preferably 25 p.p.m. to 100 p.p.m.--.

Signed and Sealed this
Twenty-eighth Day of December 1976

[SEAL]

*Attest:*

RUTH C. MASON
*Attesting Officer*

C. MARSHALL DANN
*Commissioner of Patents and Trademarks*